United States Patent [19]

Chraplyvy et al.

[11] 4,347,086

[45] Aug. 31, 1982

[54] SELECTIVE MAGNETIZATION OF RARE-EARTH TRANSITION METAL ALLOYS

[75] Inventors: Andrew R. Chraplyvy, Troy; Jan F. Herbst, Warren; John J. Croat, Sterling Heights, all of Mich.

[73] Assignee: General Motors Corporation, Detroit, Mich.

[21] Appl. No.: 138,240

[22] Filed: Apr. 7, 1980

[51] Int. Cl.[3] ..... H01F 1/00

[52] U.S. Cl. ..... 148/101; 204/192 M; 148/121

[58] Field of Search ..... 148/101, 102, 103, 108, 148/121, 127; 204/192 M; 365/34, 97

[56] References Cited

U.S. PATENT DOCUMENTS

| | | | |
|---|---|---|---|
| 3,116,181 | 12/1963 | Hokkeling et al. | 148/31.57 |
| 3,276,922 | 10/1966 | Sery et al. | 148/101 |
| 3,661,567 | 5/1972 | Yamamoto et al. | 148/31.57 |
| 3,676,867 | 7/1972 | Bacon et al. | 148/31.57 |
| 4,126,494 | 11/1978 | Imamura et al. | 148/103 |
| 4,265,684 | 5/1981 | Boll | 148/121 |

OTHER PUBLICATIONS

Clark, A. E., "High-field magnetization and coercivity of amorphous rare-earth-$Fe_2$ alloys", Appl. Phys. Lett., vol. 23, No. 11, Dec. 1, 1973, pp. 642-644.

The Condensed Chemical Dictionary, 8th ed., 1971, p. 753.

Balbashov et al., "Thermomagnetic Recording in the Surface Layer of an Orthoferrite", Soviet Technical Physical Letters for (4), Apr. 1978.

*Primary Examiner*—John P. Sheehan

*Attorney, Agent, or Firm*—Elizabeth F. Harasek

[57] ABSTRACT

An amorphous rare-earth transition metal body is provided that has integral, predetermined regions of hard and soft magnetism. A method is provided for heating portions of an amorphous rare-earth transition metal alloy body, in situ, to transform predetermined portions from a state of low magnetic coercivity to a highly magnetically coercive state.

3 Claims, 2 Drawing Figures

SELECTIVE MAGNETIZATION OF RARE-EARTH TRANSITION METAL ALLOYS

BACKGROUND OF THE INVENTION

This invention relates to an amorphous, magnetically soft body of rare-earth and transition metals (RE-TM) wherein a well-defined portion of the body has been tempered to obtain hard magnetic characteristics. The invention also relates to a method of making RE-TM bodies with regions of both soft and hard magnetism.

Many rare-earth transition metal compositions have superior magnetic properties. RE-TM magnet alloys contain one or more of the rare-earth metals combined in suitable proportions with one or more of the magnetic transition metals, such as iron, nickel, or cobalt. Permanently magnetized RE-TM materials may have two-to-six times the magnetic energy of aluminum-nickel-cobalt type (Alnico) magnets, and be fifty-times as resistant to demagnetization by an external magnetic field. Because the RE-TM alloys may have high magnetic coercivities and energies, even relatively small permanently magnetized bodies may serve in heavy-duty purposes such as stator magnets for DC motors.

Magnetic materials are generally classified as "hard" or "soft". A hard magnetic material is difficult to magnetize and to demagnetize. A body of hard magnetic material with residual magnetism is referred to as a "permanent" magnet. A soft magnetic material is easily magnetized and demagnetized. Coercivity is a measure of magnetic hardness. A soft magnet has a coercivity close to zero. A hard RE-TM alloy magnet typically has a coercivity of thousands of Oersteds.

It is known that certain RE-TM alloys can be transformed from a magnetically soft state to a magnetically hard state by a suitable heat treatment. For example, A. C. Clarke reported in Applied Physics Letters, Vol. 23, page 642 (1973) that a magnetically soft body of $TbFe_2$ which has a substantially noncrystalline (amorphous) microstructure can be transformed into a hard magnetic state by heating to a suitable temperature above about 350° C. The treated material is substantially crystalline in nature.

Herein, the process of heating an amorphous rare-earth transition metal alloy of low magnetic coercivity to a temperature below its melting temperature such that it is at least partially crystallized to a state where the alloy has relatively high magnetic coercivity is referred to as "tempering".

Table I lists a number of rare-earth transition metal alloys that can be sputtered onto a backing in an amorphous state in which they are magnetically soft. This list is not inclusive of all such alloys, but merely representative of RE-TM alloys believed to be adaptable for the practice of the invention.

TABLE I

| | | |
|---|---|---|
| $SmCo_5$ | $Sm_2(Co_{0.5}Fe_{0.5})_{17}$ | $TmFe_2$ |
| $Sm_{0.5}Pr_{0.5}Co_5$ | SmFeCo | $ErFe_2$ |
| $PrCo_3$ | $SmFe_2$ | $DyFe_2$ |
| $Pr(Co_{0.9}Fe_{0.1})_5$ | $PrFe_2$ | $HoFe_2$ |
| $YCo_5$ | $YFe_2$ | $TbFe_2$ |
| $Sm_2Co_{17}$ | $GdFe_2$ | $TbFe_3$ |
| $Sm_2(Co_{0.7}Fe_{0.3})_{17}$ | $YbFe_2$ | $Tb_2Fe_{17}$ |

There are applications wherein it would be desirable to induce magnetic coercivity in only a selected region of an amorphous rare-earth transition metal alloy of low magnetic coercivity. For example, a cylindrical stator magnet for a DC motor could be tempered in selected regions to optimize the magnetic field for motor operation. Before this invention, it was not known how to tailor the magnetics of a unitary RE-TM body to achieve well-defined regions of both hard and soft magnetism.

OBJECTS OF THE INVENTION

It is an object of this invention to form a rare-earth transition metal body having a magnetically hard, microcrystalline portion integral with an amorphous magnetically soft portion. It is a more particular object to provide a rare-earth transition metal body of relatively low residual magnetic coercivity with a well-defined region or regions of high magnetic coercivity. It is another object to provide an amorphous, magnetically soft rare-earth transition metal body carrying magnetically readable information in the form of one or more integral regions of high magnetic coercivity.

Another object of the invention is to provide regions of hard and soft magnetism in a unitary RE-TM body formed by sputtering a RE-TM alloy target onto a backing at a temperature such that the sputtered body is amorphous and a soft magnet. Thereafter, a selected region or regions of the body are heated to a temperature whereat the amorphous alloy becomes suitably crystalline to have high magnetic coercivity.

It is another object of the invention to provide a method of inducing regions of high magnetic coercivity in amorphous, substantially noncrystalline, rare-earth transition metal alloy bodies by heating the regions to a temperature whereat crystallization of the alloy microstructure takes place. A more specific object of the invention is to provide selected portions of magnetically soft, amorphous RE-TM bodies with much higher magnetic coercivity by heating those regions in situ with high intensity, focused radiation such as laser light or an electron beam.

BRIEF SUMMARY OF THE INVENTION

In accordance with the preferred embodiment of the invention, a body of an amorphous, low-coercivity rare-earth transition metal alloy such as $TbFe_2$ or $PrCo_3$ is provided. A source of intense radiation, capable of rapidly transmitting energy to the alloy, is focused on that portion of the alloy body to be transformed from a soft to a hard magnetic state. A suitable radiation means would be, e.g., an 8 Watt argon ion laser. Radiation exposure on the portion is continued until it is heated to a temperature whereat the amorphous alloy is converted to a microcrystalline state of substantially higher magnetic coercivity. This phase transition generally takes only a few seconds with a focused laser beam. Excessive heating is avoided because it may promote excessive grain growth (resulting in decreased coercivity) in the directly heated portion, and undesired heating of adjacent portions. For amorphous $TbFe_2$ or $PrCo_3$, the phase transition temperature is above about 350° C.

The treated body is thereafter exposed to an external magnetic field of suitable strength and polarity to induce residual magnetism in the magnetically hard, heat tempered portion.

DETAILED DESCRIPTION OF THE INVENTION

Our invention will be better understood in view of the following Figures and detailed description.

Figure 1:
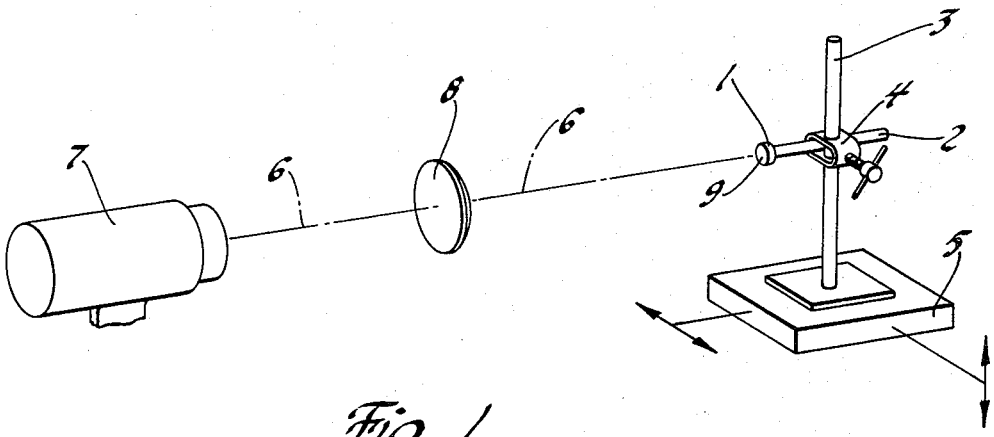
Figure 2:
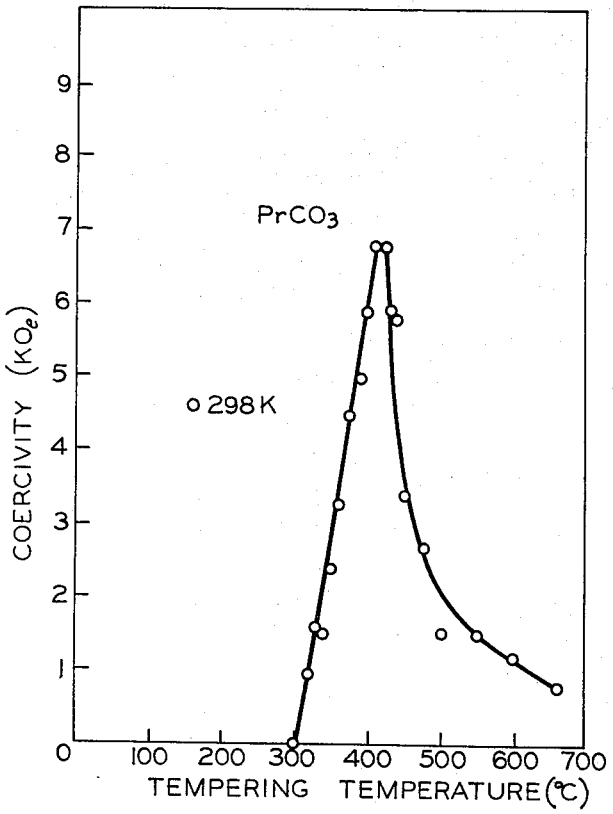

In the Figures:

FIG. 1 shows an apparatus for tempering a selected portion of an amorphous, magnetically soft RE-TM alloy to a magnetically hard state with a laser, and FIG. 2 is a plot of room temperature magnetic coercivity for initially amorphous $PrCo_3$ as a function of tempering temperature.

Amorphous $PrCo_3$ was prepared by rapid D.C. sputtering. The optimum tempering temperature range for $PrCo_3$ was determined as follows. Samples of the sputtered material were tempered in an oven for 10 minutes at temperatures between 300° C. and 650° C. Tempering caused a phase transformation of the amorphous alloy to a crystalline state. The samples were then subjected to a 15 KOe magnetizing field. Their residual magnetism was measured at room temperature in a magnetometer. FIG. 2 is a plot of the intrinsic magnetic coercivity of the samples as a function of tempering temperature. It can be seen that the samples treated at 400° C. showed the highest intrinsic magnetic coercivity. Amorphous samples tempered at temperatures between about 350° C. and 450° C. showed significantly increased coercivities. This is the preferred temperature range for tempering a selected portion of a $PrCo_3$ body by means of focused radiation.

A roughly cylindrical sample of the sputtered $PrCo_3$, about 10 mm in diameter and 2 mm thick, was formed. It was polished to a flat surface on one side and then treated in an apparatus like that shown at FIG. 1. As shown thereat, sample 1 was attached to a glass support tube 2 which was mounted on ring stand 3 by means of clamp 4. Ring stand 3 was set on stage 5 adapted with vertical and horizontal translation capabilities as indicated by the arrows. A radiation beam 6 generated by laser 7 was focused through lens 8 onto the surface 9 of sample 1. Beam 6 was traced along surface 9 by translating stage 5. Beam exposure was continued in each spot to be made magnetically coercive until melting was observed at the surface of the sample. After radiation was complete, the surface of the sample was polished to remove any melted alloy and reveal the alloy beneath that had been heated to the desired tempering temperature between about 350° C. and 450° C.

The sample was then exposed to a magnetic field of about 15 kilo Oersteds. Nickel powder was sprinkled on the tempered surface. The powder was magnetically attracted only to the region of the sample that had been tempered by the laser. Thus, the laser tempered and magnetized region exhibited hard magnetic properties while the untreated amorphous region did not.

A region of magnetism formed as above in an amorphous, magnetically soft RE-TM body is detectable, e.g., by magnetic pick-ups of the type used to decipher tape recorded information. The RE-TM bodies may be relatively large, self-supporting structures or thin layers carried on suitable substrates. Because the tempered regions are not easily demagnetized by shock, temperatures below about 300° C., or external magnetic fields, the subject RE-TM bodies may be used in environments generally destructive to other magnetic materials. One application could be a read-only memory for a microprocessor for use in a rugged automotive, under-hood environment.

It is impossible to achieve selective coercivity in amorphous RE-TM alloys using conventional oven-tempering techniques. Unlike lasers, ovens provide no way of injecting concentrated energy into a small region of an alloy body. While the invention has been described in terms of using laser radiation to perform the tempering as described above, other sources of radiation would be equally suited to the practice of the invention. Any source of electromagnetic or particle radiation which can be focused to inject sufficient energy into an amorphous RE-TM alloy to heat it to its transformation temperature would be acceptable.

While the invention has been described in terms of a specific embodiment thereof, other forms may be adapted by one skilled in the art. Therefore, the invention is to be limited only by the following claims.

The embodiments of the invention in which an exclusive property or privilege is claimed are defined as follows:

1. A method of forming an integral region of hard magnetism in a portion of a magnetically soft rare-earth transition metal alloy body comprising forming said alloy body to place it entirely in an amorphous, magnetically soft condition and thereafter selectively tempering the portion of said body in said region to convert the structure of the alloy thereat from an amorphous to a crystalline state such that said region has high magnetic coercivity.

2. A method of making a body of rare-earth transition metal alloy having a first amorphous portion that has soft magnet characteristics and an integral second crystalline portion that has hard magnet characteristics comprising:

sputtering a mixture of rare-earth and transition metals to form said alloy in an amorphous, soft magnetic state;

forming said body from said alloy;

and selectively treating the said second portion of the body by heating it to a temperature whereat the alloy thereat is converted to a crystalline form that has high intrinsic magnetic coercivity, the balance of said body remaining in an amorphous state.

3. A method of making a body of $PrCo_3$ having a first amorphous portion that has soft magnet characteristics and an integral second crystalline portion that has hard magnet characteristics comprising:

sputtering praseodymium and cobalt onto a cooled substrate in an atomic ratio of 1:3 to form a $PrCo_3$ alloy that is amorphous and has soft magnet characteristics;

forming said body from said alloy;

selectively heating said second portion of said body to a temperature in the range of from about 350°–450° C. such that the amorphous alloy of the portion is is substantially transformed to a crystalline state of high magnetic coercivity.

* * * * *